US011629536B2

(12) United States Patent
Maskara

(10) Patent No.: US 11,629,536 B2
(45) Date of Patent: Apr. 18, 2023

(54) METHOD OF ATTACHING AND DETACHING OBJECTS ALLOWING FOR CONTROLLED ROTATION

(71) Applicant: Pankaj Kumar Maskara, Weston, FL (US)

(72) Inventor: Pankaj Kumar Maskara, Weston, FL (US)

( * ) Notice: Subject to any disclaimer, the term of this patent is extended or adjusted under 35 U.S.C. 154(b) by 0 days.

(21) Appl. No.: 17/665,549

(22) Filed: Feb. 6, 2022

(65) Prior Publication Data

US 2022/0298837 A1 Sep. 22, 2022

Related U.S. Application Data

(60) Provisional application No. 63/164,212, filed on Mar. 22, 2021.

(51) Int. Cl.
*E05D 7/10* (2006.01)
*E05D 1/06* (2006.01)

(52) U.S. Cl.
CPC ..... *E05D 7/1022* (2013.01); *E05D 1/06* (2013.01)

(58) Field of Classification Search
CPC ..... E05D 7/10; E05D 7/1005; E05D 7/1016; E05D 7/1044; E05D 7/105; E05D 7/1022; E05D 7/1055; E05D 2007/1027; E05D 1/06; E05D 5/128; E05D 5/16; E05D 5/065; E05D 5/10; E05D 7/12; E05D 7/123; E05D 2007/126; H02B 1/38; H02B 1/44; H02B 1/46; Y10T 16/53613; Y10T 16/5361; Y10T 16/536075; Y10T 16/5478; Y10T 16/551
See application file for complete search history.

(56) References Cited

U.S. PATENT DOCUMENTS 2,484,581 A * 10/1949 Pallmen ..... E05D 1/06 16/257
2,534,998 A * 12/1950 Steinbach ..... E05D 7/1011 16/229
2,636,211 A * 4/1953 Williams ..... E05D 11/04 16/275

(Continued)

FOREIGN PATENT DOCUMENTS

DE 2063165 A1 * 7/1971
GB 2568123 A * 5/2019 ..... E05D 1/04

*Primary Examiner* — Chuck Y Mah

(57) ABSTRACT

An apparatus for attaching and detaching hard objects allowing for rotation wherein protrusions built in or attached to one object are forced into cavity sockets built in or attached to another by causing force resulting in momentary bending of protrusions or the cavities. The sequential bending causes curvilinear motion allowing protrusions to enter otherwise inaccessible cavity sockets. Once in, the components of the joining mechanism revert to natural position and an equilibrium is reached which keeps the objects attached, yet free to move around an axis. This equilibrium can only be disturbed by causing force at specific points on the mechanism and pulling the objects apart in a curvilinear motion, thereby detaching the objects in one continuous motion with little effort. Momentary bending necessary to operate the apparatus is made possible by empty space in the casing housing the mechanism. Permitted angles of rotation are controllable and attached objects can be locked in a position.

5 Claims, 21 Drawing Sheets

(56) References Cited

U.S. PATENT DOCUMENTS

| | | | | | |
|---|---|---|---|---|---|
| 2,765,488 | A * | 10/1956 | Ruff | E05D 1/06 | 16/262 |
| 3,375,546 | A * | 4/1968 | Peterson | E05D 7/1044 | 16/258 |
| 4,109,821 | A * | 8/1978 | Lutz | B29C 45/0017 | 16/DIG. 13 |
| 5,127,132 | A * | 7/1992 | Karlin | E05D 7/1055 | 16/265 |
| 5,455,987 | A * | 10/1995 | Svehaug | E05F 1/063 | 16/385 |
| 5,539,956 | A * | 7/1996 | Wallace | E05D 7/10 | 16/261 |
| 5,745,953 | A * | 5/1998 | Golden | E05D 1/06 | 16/260 |
| 5,815,379 | A * | 9/1998 | Mundt | G06F 1/181 | 361/679.55 |
| 5,940,934 | A * | 8/1999 | Turner | E05D 7/1011 | 16/257 |
| 6,233,784 | B1 * | 5/2001 | Daoud | E05D 7/1077 | 16/229 |
| 7,401,380 | B2 * | 7/2008 | Herring | H05K 5/0226 | 16/268 |
| 8,661,991 | B2 * | 3/2014 | Eveleth | A47B 3/08 | 108/115 |
| 10,442,580 | B2 * | 10/2019 | Murrill | E05D 3/06 | |
| 2012/0151716 | A1 * | 6/2012 | Holstensson | E05D 3/12 | 16/224 |

* cited by examiner

52

51

METHOD OF ATTACHING AND DETACHING OBJECTS ALLOWING FOR CONTROLLED ROTATION

FIELD

The present invention relates to a method of attaching two objects in a way that they can be easily detached, when desired, in one easy motion, without the use of a tool. The method also permits the objects to rotate around a common axis where they are attached.

BACKGROUND

The importance of being able to connect and disconnect two objects easily in our daily life cannot be overemphasized. It has widespread applications especially when it is desirable to change the angle of that connection in an easy and controlled way repeatedly.

Presently we have various mechanisms to attach objects. A zipper allows easy attachment and detachment in one single motion. A Velcro also allows that. However, zippers are not suitable for use with products made of rigid material like metal and do not permit rotation. They are used with flexible material like cloth. Velcro also works with relatively flexible material and does not allow for rotation. In instances where easy attachment and detachment is important one can use magnets or the slide-in mechanism. In some instances, a Post-it notes type of easy peel-off adhesive can also be useful. However, the slide-in mechanism generally requires large clearance space on one dimension to slide the connector in the cavity. On the other hand, magnets have potential to cause interference with surrounding objects. Easy peel-off adhesives are not designed for long term repeated use.

Door hinges allow for rotation and work with hard objects. They have a rod like structure connecting the cavity of the shafts attached to the two objects. Though easy to operate once installed, the process of installing hinges with slide-in pins is involved and requires precision. On the other hand, continuous hinges have long rods and are easy to install but are not designed to be taken apart in regular operation. Door hinges are not designed for use when rotational movement is not required.

SUMMARY

An apparatus for attaching and detaching objects in a sliding or pull-apart motion without the need for a tool allows easy handling of tasks in day-to-day life.

The disclosed exemplary embodiments provide a method to attach two objects made from wide range of material including wood, metal, and plastics in a continuous motion without requiring the use of any tool for attachment or detachment.

The method involves shafts connected to objects to be attached, by standard mechanisms like screws and adhesives. One of the shafts has semi-sphere-shaped cavities at specific intervals. The other shaft has connector arms and/or pills with semi-sphere-shaped bottoms that are appropriately spaced to engage with respective cavities.

The process of attaching involves momentary bending of the shaft at the appropriate location to allow pills to enter or exit their cavities at slightly inclined position. Each pill returns to straight position once positioned in its cavity, thereby returning the shaft to its natural state. The spherical shape of the cavities holds the pills, and therefore the other object in place. The connected object can then rotate around the axis formed by connecting the center of the semi sphere cavities.

When needing to detach the objects, the user can pull apart the two objects resulting in easy separation in smooth curvilinear motion. This method was envisioned by Pallmen (2,484,581) in 1949. However, the method requires at least one of the objects to be flexible.

The novelty of the present invention is that it works even when none of the objects to be connected offer required flexibility. A flexible shaft is housed in a casing attached to one of the objects, wherein the casing affords enough space to the flexible shaft to bend momentarily during operation. In such a situation a simple sliding knob can be used to exert required force to cause momentary bending of the pills to attach the objects. Furthermore, the present invention allows control of permitted rotation and locking of the joined objects in a desired position using a recess and a lock pin.

Further objects, features, advantages and properties of the joining mechanism according to the present application will become apparent from the detailed description.

BRIEF DESCRIPTION OF THE DRAWINGS

In the following detailed portion of the present description, the teachings of the present application will be explained in more detail with reference to the example embodiments shown in the drawings, in which:

FIG. 5A shows the front view without casing while

DETAILED DESCRIPTION

The following detailed description in combination with the figures is provided to assist in understanding the teachings herein. The discussion focuses on specific implementations and embodiments to assist in describing the teachings. This focus should not be interpreted as a limitation on the scope or the applicability of the teachings.

To simplify demonstration all figures have been shown with a few pills but there is no limit to the number of pills in the invention described herein.

The implementation shown herein relies on the flexibility of the pill shaft but either of the pill shaft or the cavity shaft or both can be flexible.

We have demonstrated the functioning of the mechanism with standalone pill plate and cavity plate, each with a shaft and or connectors to hold cavities and pills at desired positions. However, the pills and cavities can be built into the objects during manufacturing, thereby nullifying the need for shafts and/or connectors to hold the pills or cavities in place. Similarly, the casing can be built into the object during manufacturing.

Rotation of the joining mechanism in the embodiment described herein, unless otherwise qualified, refers to operation of the joining mechanism like a door hinge.

The joining mechanism is referred to as engaged or attached when the pill plate and the cavity plate are connected.

Even though we have presented the drawings and discussed the invention from the perspective that the hinge shaft is vertical to the ground, the mechanism will work in any direction (horizontal, vertical, up or down).

Figure 1A:
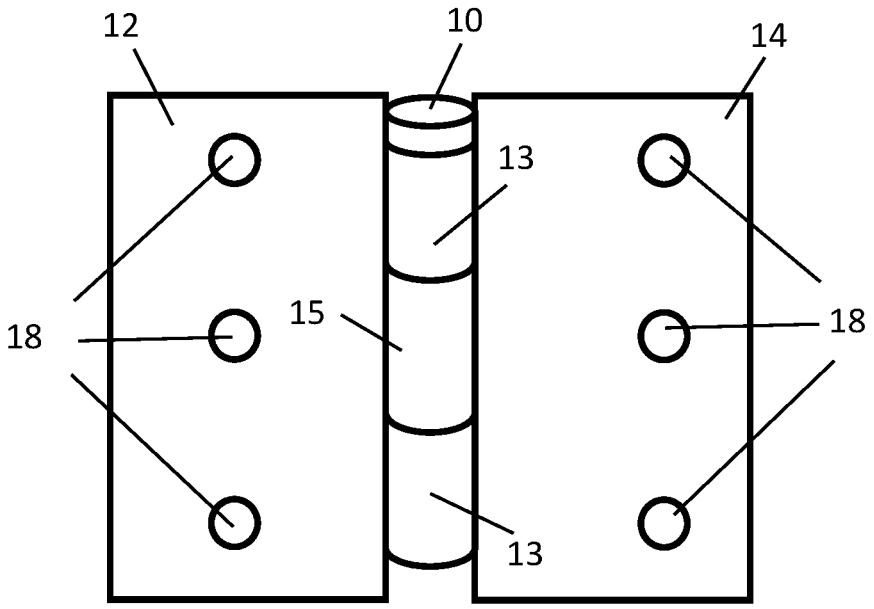
Fig. 1A Prior Art
FIG. 1A shows prior art of door hinge mechanism with a pin.
Figure 1B:
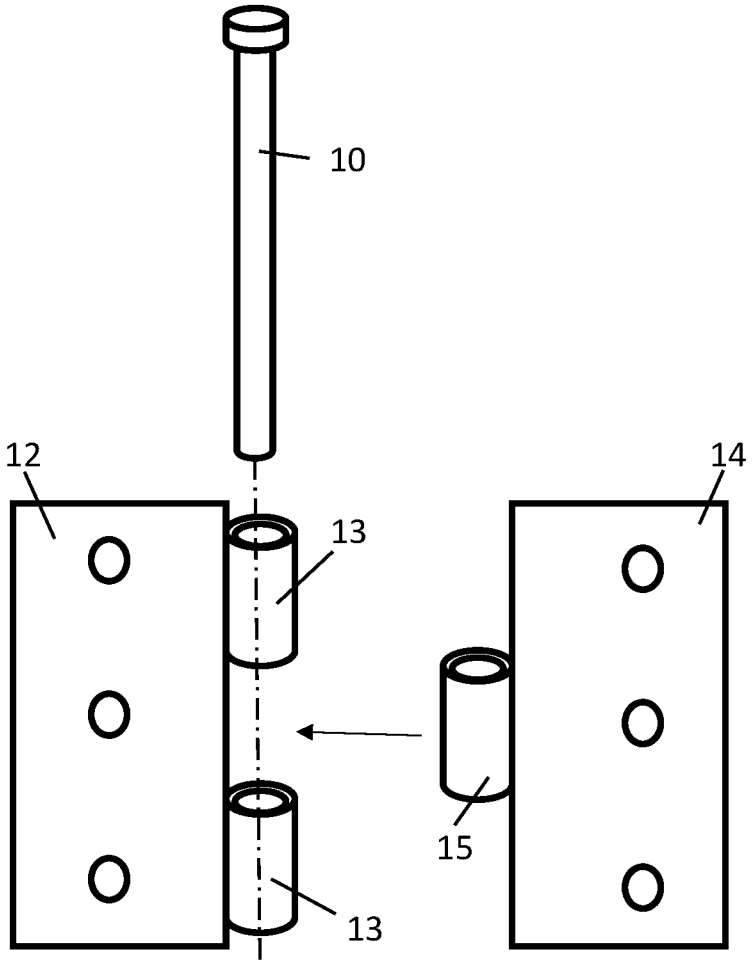
Fig. 1B Prior Art
FIG. 1B shows exploded view of the prior art in FIG. 1A.

FIG. 1A and FIG. 1B show prior art for a standard door hinge with two plates and a pin. In the embodiment shown in FIG. 1A, the left plate [12] has three screw holes [18] and two hollow cylindrical sockets [13]. The right plate [14] has three screw holes [18] and one hollow cylindrical socket [15]. Objects are affixed to the plates using screws. A pin [10] is put through the cavity of the cylindrical sockets as shown in FIG. 1B to connect and hold the two plates together allowing for connected objects to rotate.

Figure 2A:
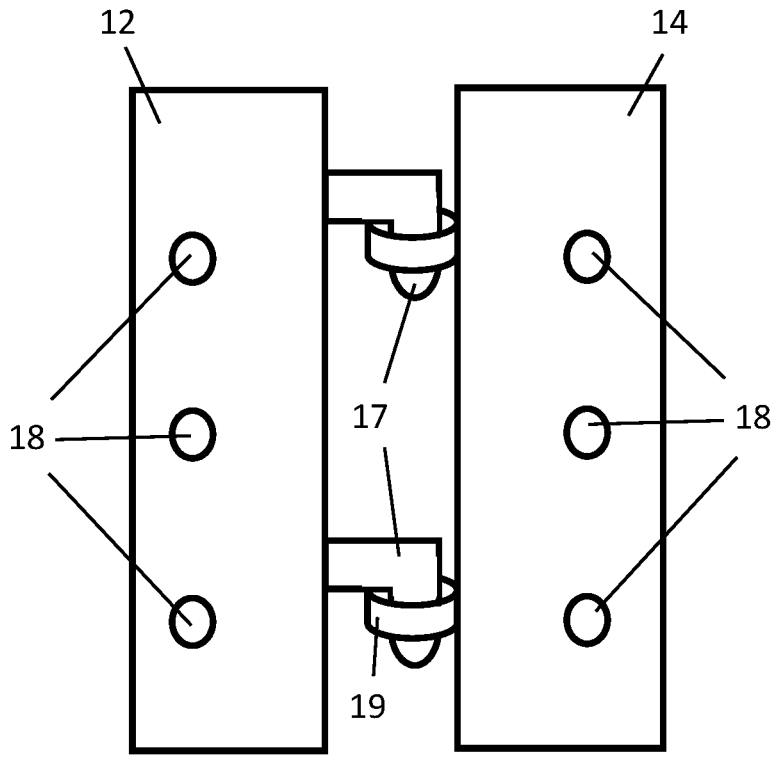
Fig. 2A Prior Art
FIG. 2A shows prior art of a hinge with pin and socket mechanism.
Figure 2B:
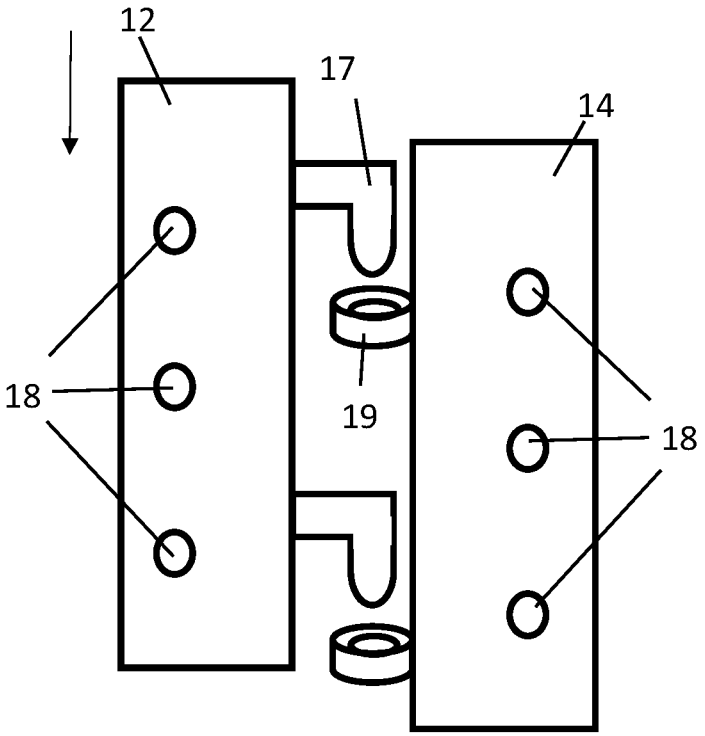
Fig. 2B Prior Art
FIG. 2B shows direction of motion needed for hinge in FIG. 2A.

FIG. 2A and FIG. 2B show prior art of a standard pin-and-socket type hinge. The embodiment of this type of hinge shown in FIG. 2A and FIG. 2B has three screw holes [18] in the right plate [12] and two elbow pins [17] connected to it. The right plate [14] has three screw holes [18] and two sockets [19]. The plates are affixed to objects using screws. The elbow pins [17] are slid into sockets [19] in the direction of the arrow shown in FIG. 2B to connect objects and allow for rotation.

Figure 3A:
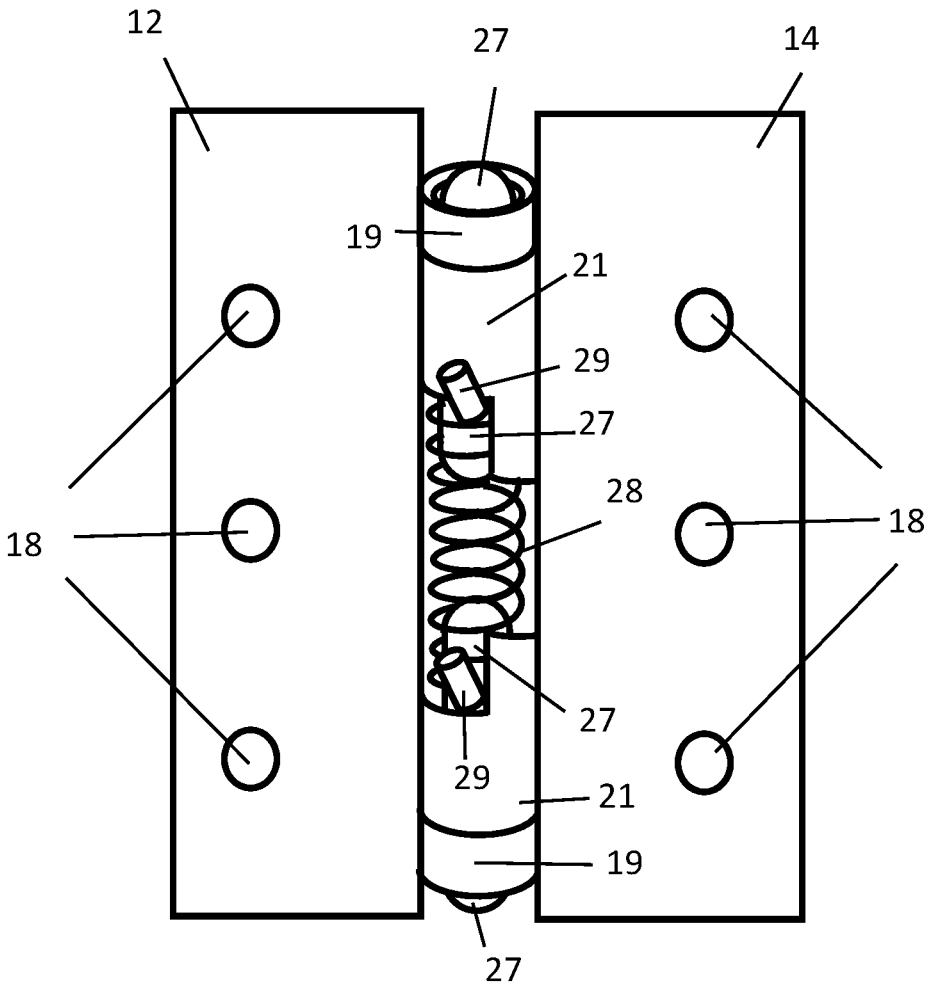
Fig. 3A Prior Art
FIG. 3A shows prior art of easy-install hinge in installed position.
Figure 3B:
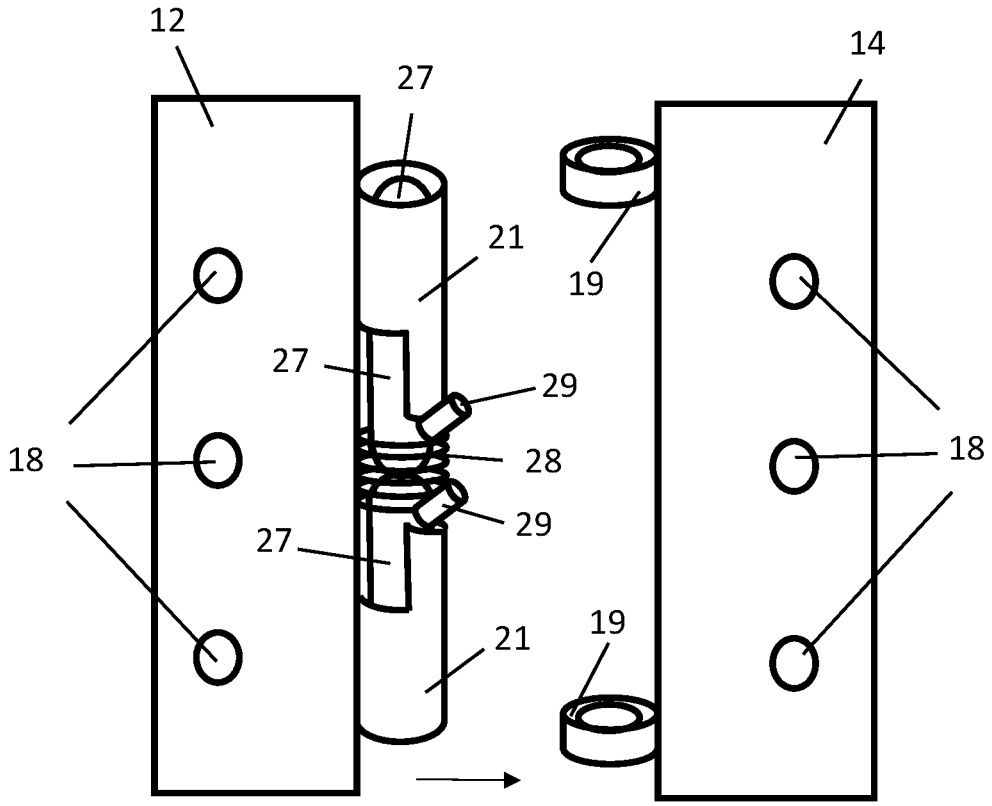
Fig. 3B Prior Art
FIG. 3B shows easy-install hinge of FIG. 3A prior to installation.

FIG. 3A and FIG. 3B show prior art for an embodiment of easy-install door hinge. The left plate [12] has a cylindrical hollow casing [21] with cut-out in the shape shown in FIG. 3A and FIG. 3B. The casing holds two cylindrical pins [27] each with a protrusion [29] held apart by a spring [28] as shown in FIG. 3A. The right plate as two sockets [19] spaced at appropriate distance based on the length of casing [21] of the left plate [12]. The user affixes both the plates to respective objects using screws. The process of connecting the plates involves pinching the two protrusions [29] to bring the pins [27] together and rotating it slightly so that the protrusions can fit in the narrow part of the cut-out as shown in FIG. 3B. The object attached to the left plate is then moved towards the object connected to the right plate [14] in the direction shown in FIG. 3B. When the pins [27] are aligned with the sockets [19] the protrusions [29] are rotated back towards the wider part of the cut-out. Due to the tension in the spring the pins [27] slide through the sockets [19] and hold their place allowing for the connected objects to rotate.

Figure 4A:
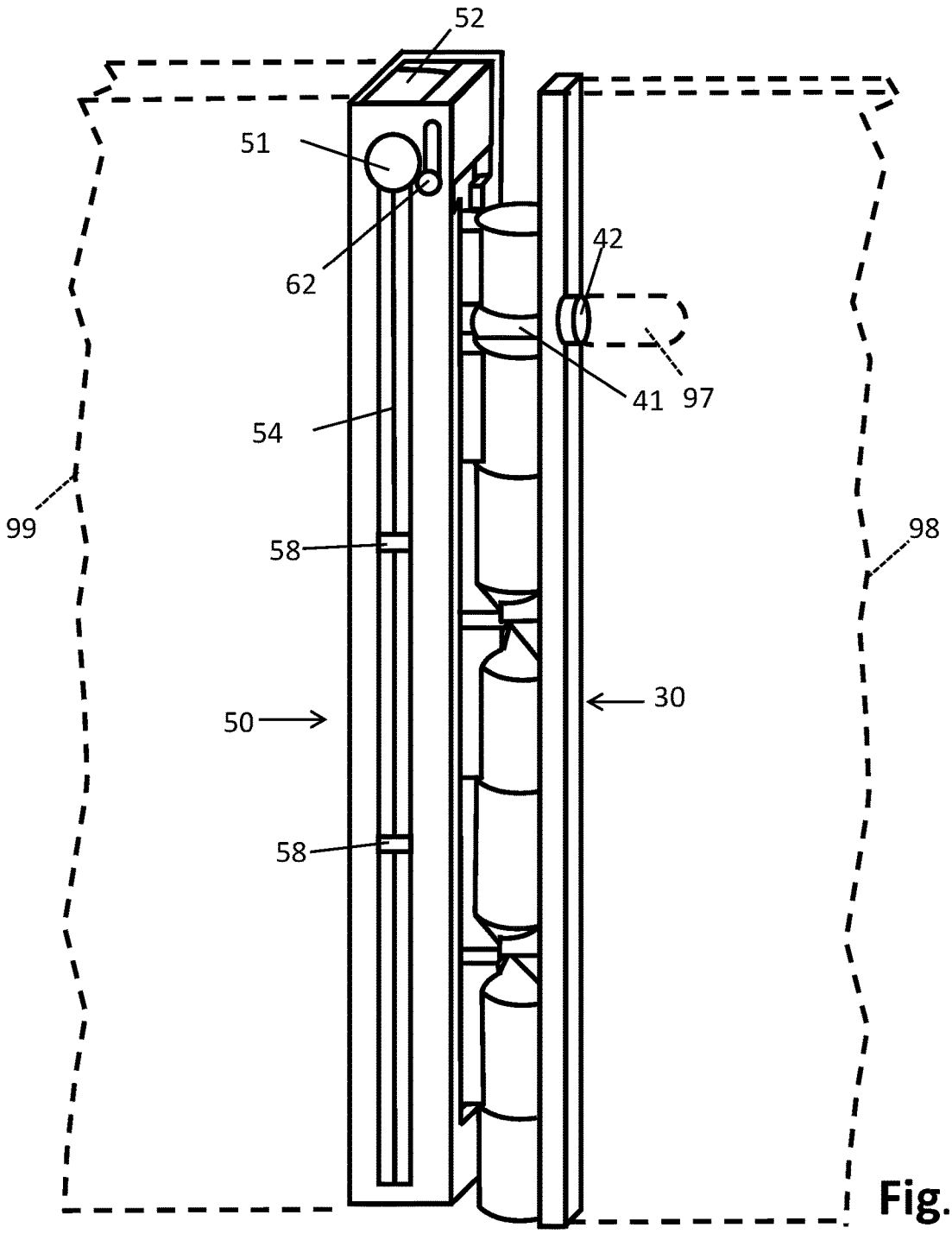
FIG. 4A shows an embodiment of the present disclosure with a casing in an attached state.

FIG. 4A shows an embodiment of the joining mechanism in an assembled and engaged state connecting two rigid objects. It shows an object [99] attached to a casing [50]. Another object [98] is connected to a cavity plate [30] and has a lock pin groove [97] to allow insertion of a pin [41] through a hole in the cavity plate [30]. Though not shown in the drawing, a standard spring connected to the pin head [42] and the lock pin groove [97] can be used to maintain the position of the pin [41] and assist in operation. The slider [52] and the slider knob [51] are in the fully engaged position.

Figure 4B:
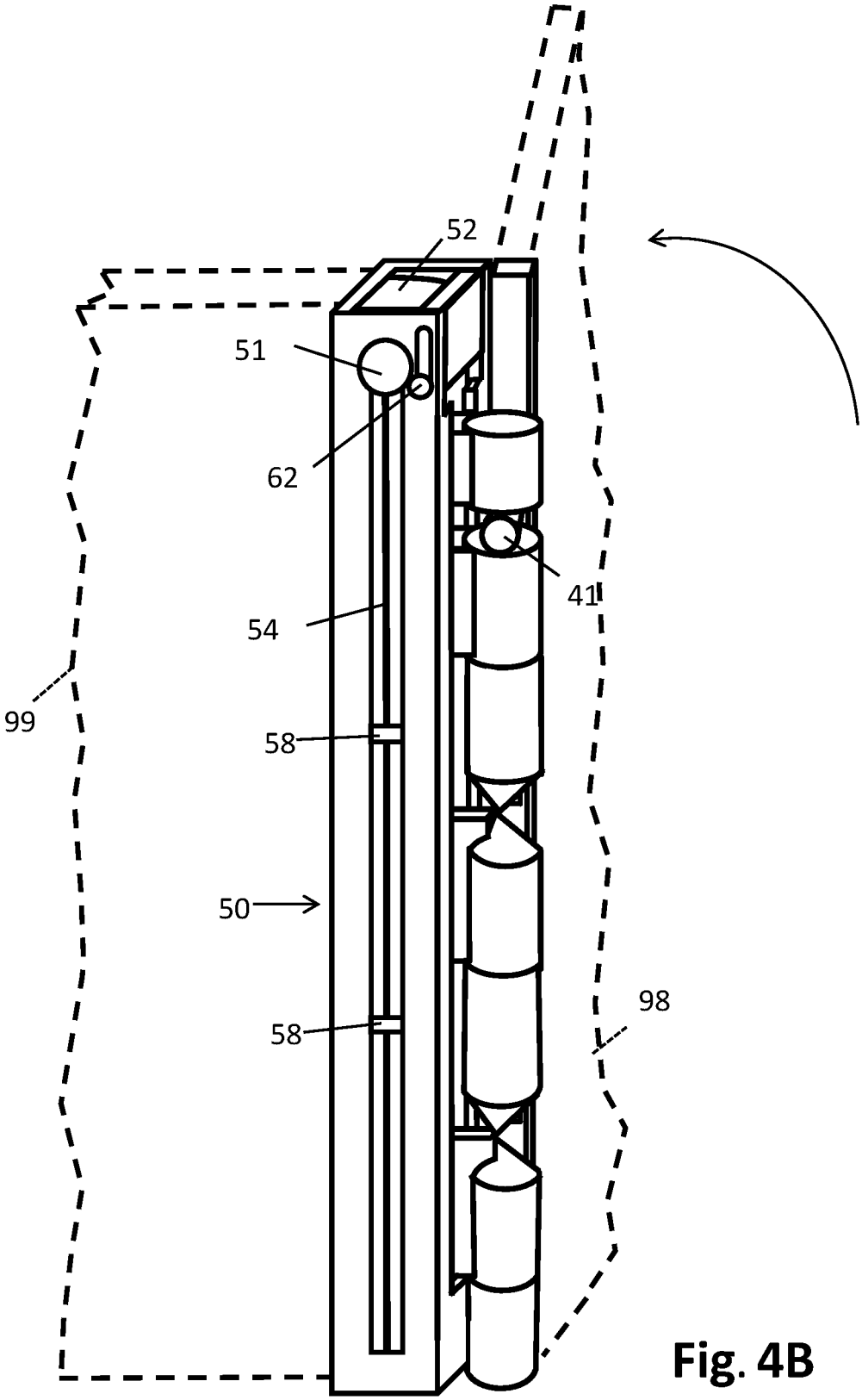
FIG. 4B shows the embodiment in FIG. 4A in a rotated position functioning like a hinge.

FIG. 4B demonstrates the rotational capability of embodiment in FIG. 4A using an arrow and the new position of the object [98]. It also shows the change in the position of pin [41] and cavity plate [30]. The following discussion will identify and explain each component of the embodiment in FIG. 4A and explain the functioning of the joining mechanism.

Figure 5A:
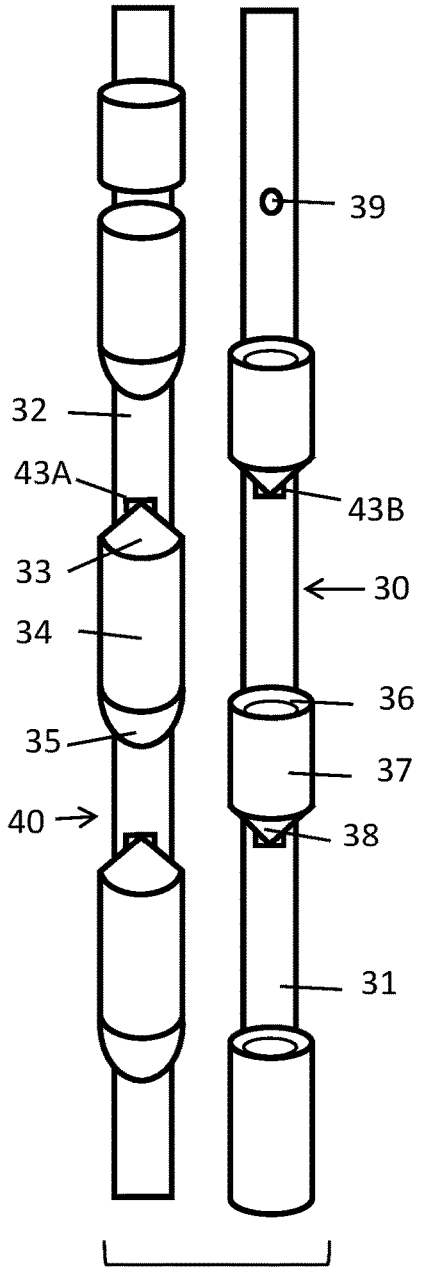
Figure 5B:
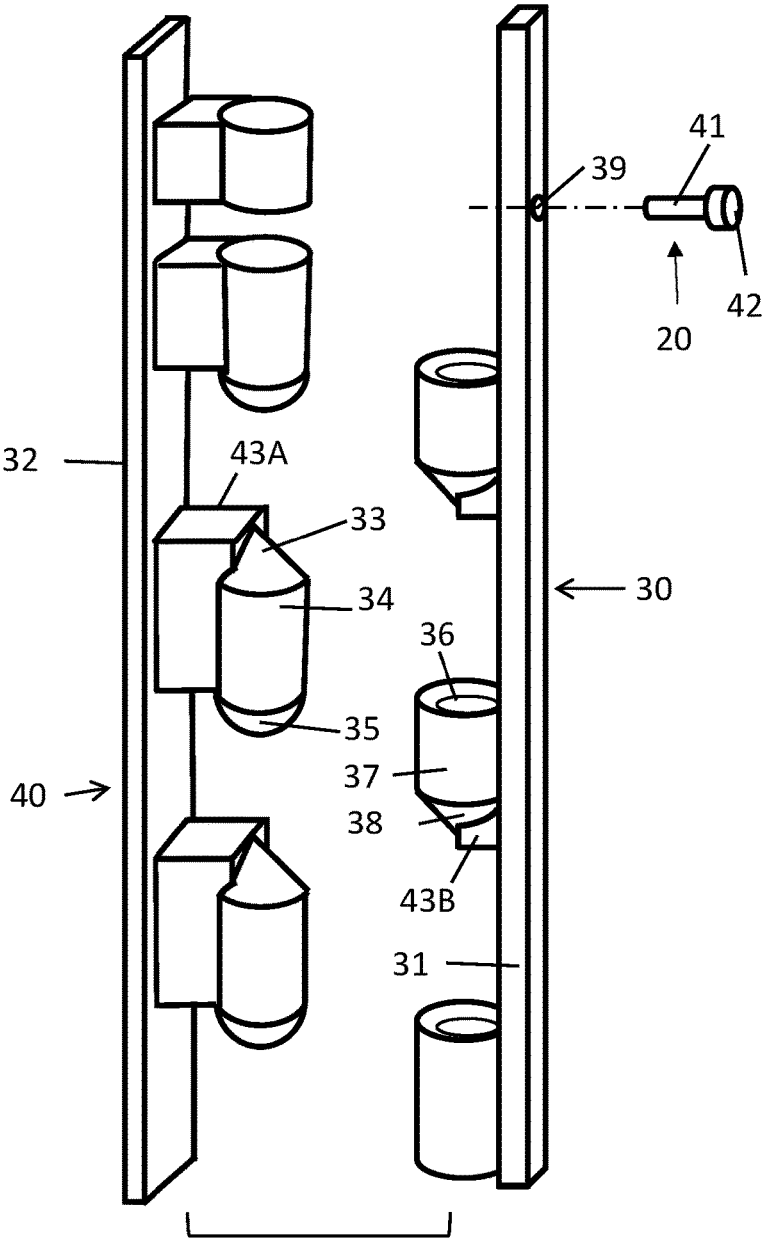
FIG. 5B shows the side view.

FIG. 5A and FIG. 5B show the front view and the side view of the two main components of the joining mechanism, respectively. These are the pill plate [40] and the cavity plate [30]. An embodiment of the pill plate shown in FIG. 5A includes a pill shaft [32], pill connectors [43A], pill guide [33], pill body [34], and pill bottom [35]. Pill guide, pill body, and pill bottom are collectively referred to as pill. An embodiment of the cavity plate shown in FIG. 5A includes a cavity shaft [31], cavity connectors [43B], cavity saucer [36], cavity body [37], and cavity guide [38], and lock pin hole [39]. Cavity saucer, cavity body, and cavity guide are collectively referred to as cavity socket. FIG. 5B shows an additional component, the lock pin [20], which includes a pin [41] and pin head [42].

For ease of reference, in instances where cavity guide or saucer is not required (for example, the bottom cavity socket in FIG. 5A does not have a cavity guide) it will still be referred to as cavity socket. Similarly, unless distinction is required by the context, pills on the pill shaft will be referred to as pills even in the absence of distinct pill guide and/or pill bottom.

Pill guide [33] is depression at the top of the pill to allow it to enter the space between two cavity sockets. Similarly, cavity guide is the depression at the bottom of a cavity socket to allow and guide the motion of the pill below it during the operation of the joining mechanism.

The pill shaft [32] and the cavity shaft [31] are collectively referred to as shafts. At least one of the shafts is of appropriate thickness and made of suitable material like plastic that allows momentary bending in the process of attachment and detachment but is otherwise stiff enough to hold its place and to provide the necessary level of support to the mechanism when not in a bent position.

Figure 5C:
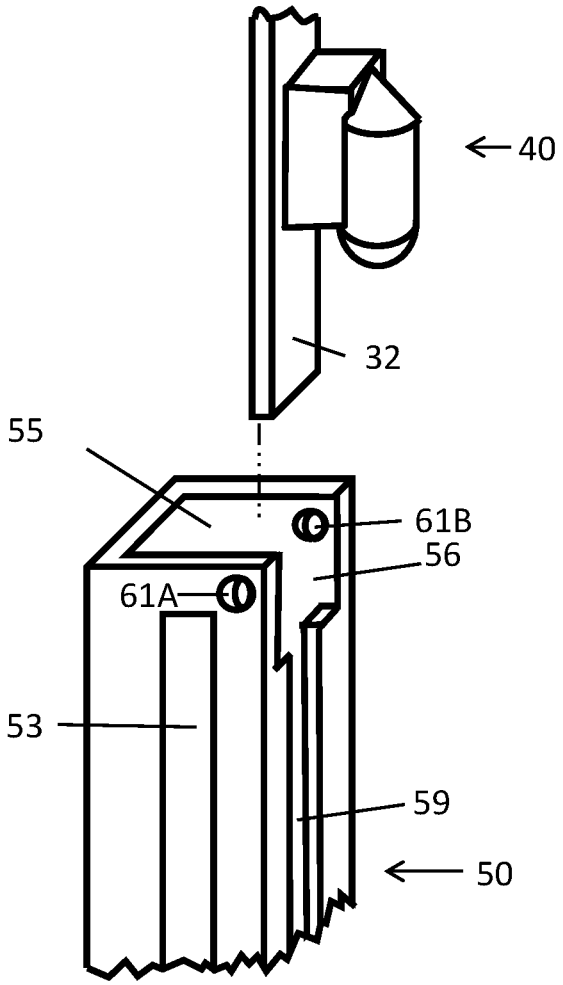
FIG. 5C shows insertion of the embodiment in FIG. 5A in a casing.

FIG. 5C shows the elements of the top portion of the casing [50]. In the embodiment shown in FIG. 4A, the casing houses the pill shaft [40]. However, a casing can be used to house the cavity shaft [31] also, if desired. The embodiment of casing shown has a cuboidal shape and is like an open-top box with four walls and a base. The phantom line in FIG. 5C shows an embodiment of how the shaft may enter casing cavity [55] through the open top. One of the sides of the casing has an opening referred to as slider cavity [53] designed to facilitate handling of the slider [52]. The side adjacent to the side with slider cavity [53] on the right, as shown in FIG. 5C, has an opening referred to as connector cavity [59]. The cavity is designed to hold the pill shaft [32] back into the casing [50] during operation while permitting the pills to engage with cavity sockets. The distance between, the side of the casing [50] with connector cavity and the one across it, is enough to allow the pill shaft to bend momentarily during operation.

Figure 5D:
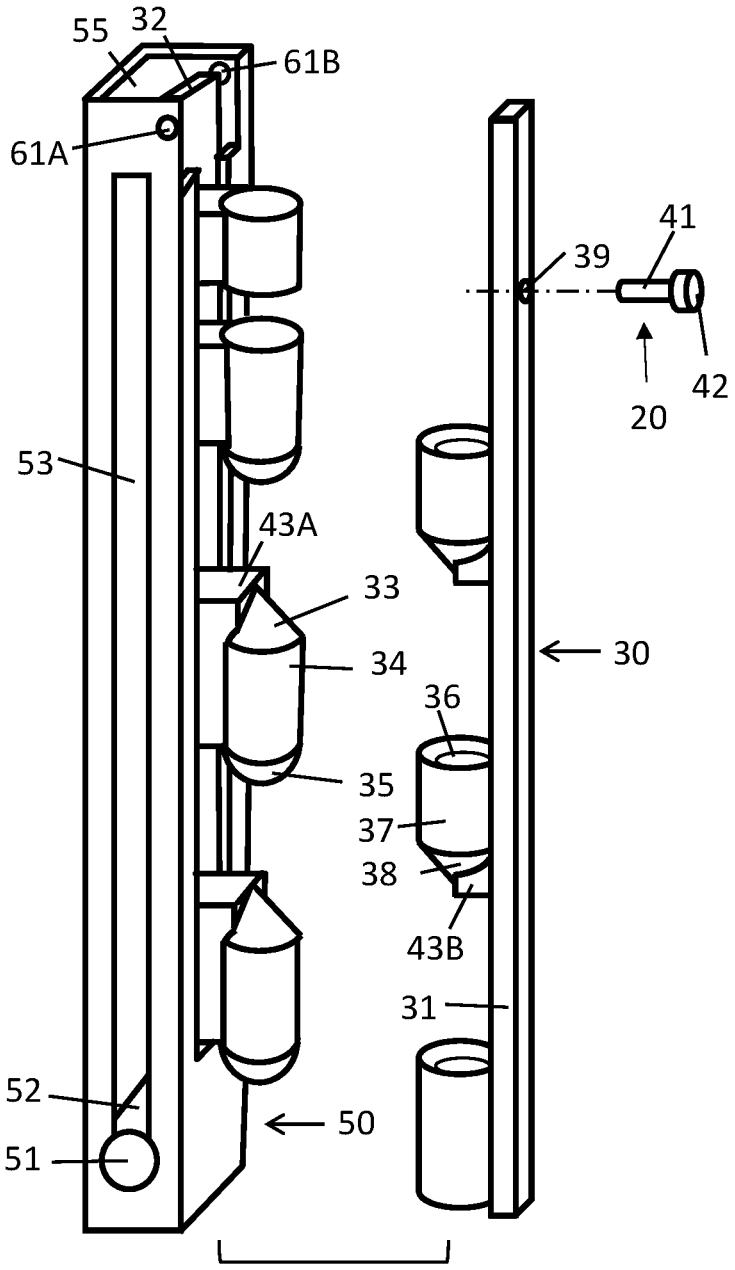
FIG. 5D shows the embodiment after insertion shown in 5C.
Figure 6A:
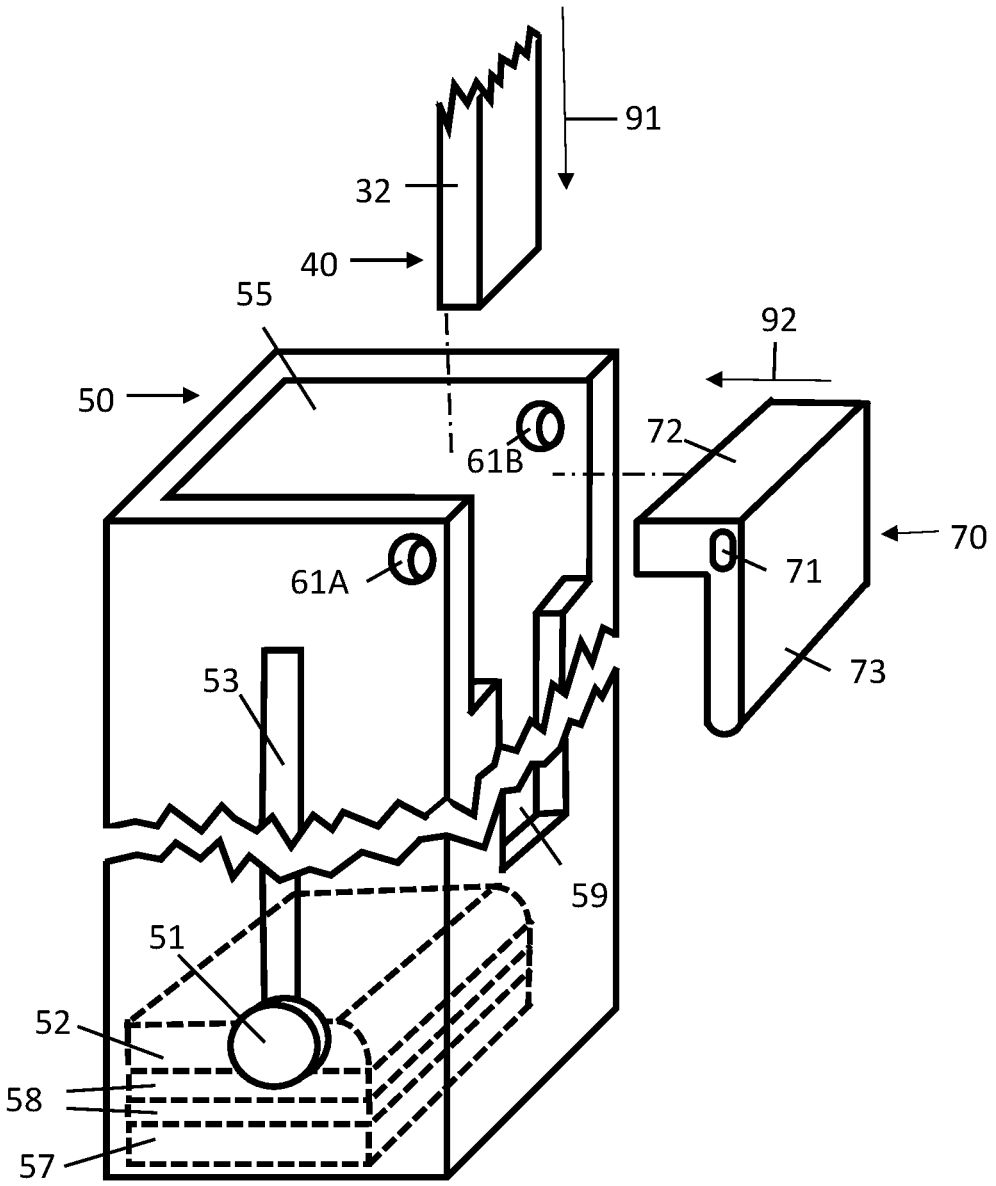
FIG. 6A shows a step of bringing together components of one part of the embodiment shown in 4A.

FIG. 5D shows the side view of the casing [50] with the pill shaft [32] installed. When the pill shaft is fully inserted into the casing, it fits tightly between pill shaft anchor [57] and the side of the casing with connector cavity [59]. The pill shaft anchor can also be thought of as a protrusion of the bottom side of the casing that creates an empty space between itself and the casing wall so as to allow the pill shaft to enter and stay in the space during operation. It is designed to hold the pill shaft tightly and keep it secured during operation, not allowing it to slide out unless user intends to disassemble. FIG. 6A shows the position of pill shaft anchor [57] in dashed lines since it is hidden inside the casing. Once the pill shaft has been placed in the casing in direction shown by arrow [91] and is secured by the pill shaft anchor [57], an embodiment of operator [70] can be positioned as shown by arrow [92] and the phantom lines in FIG. 6A. The operator has three components—operator lever cavity [71], pill shaft stabilizer [72], and pill shaft operator [73]. The pill shaft stabilizer [72] keeps the pill shaft stable from the top, when engaged. The pill shaft operator [73] is designed to push the top end of the pill shaft away from the side of the casing with the connector cavity [59] in the process of detaching the joining mechanism. FIG. 6A also shows other hidden components—slider [52] and support tiles [58]. The support tiles are designed to keep the pill shaft [32] snug with the inside wall of the casing with connector cavity [59] when the joining mechanism is engaged.

Figure 6B:
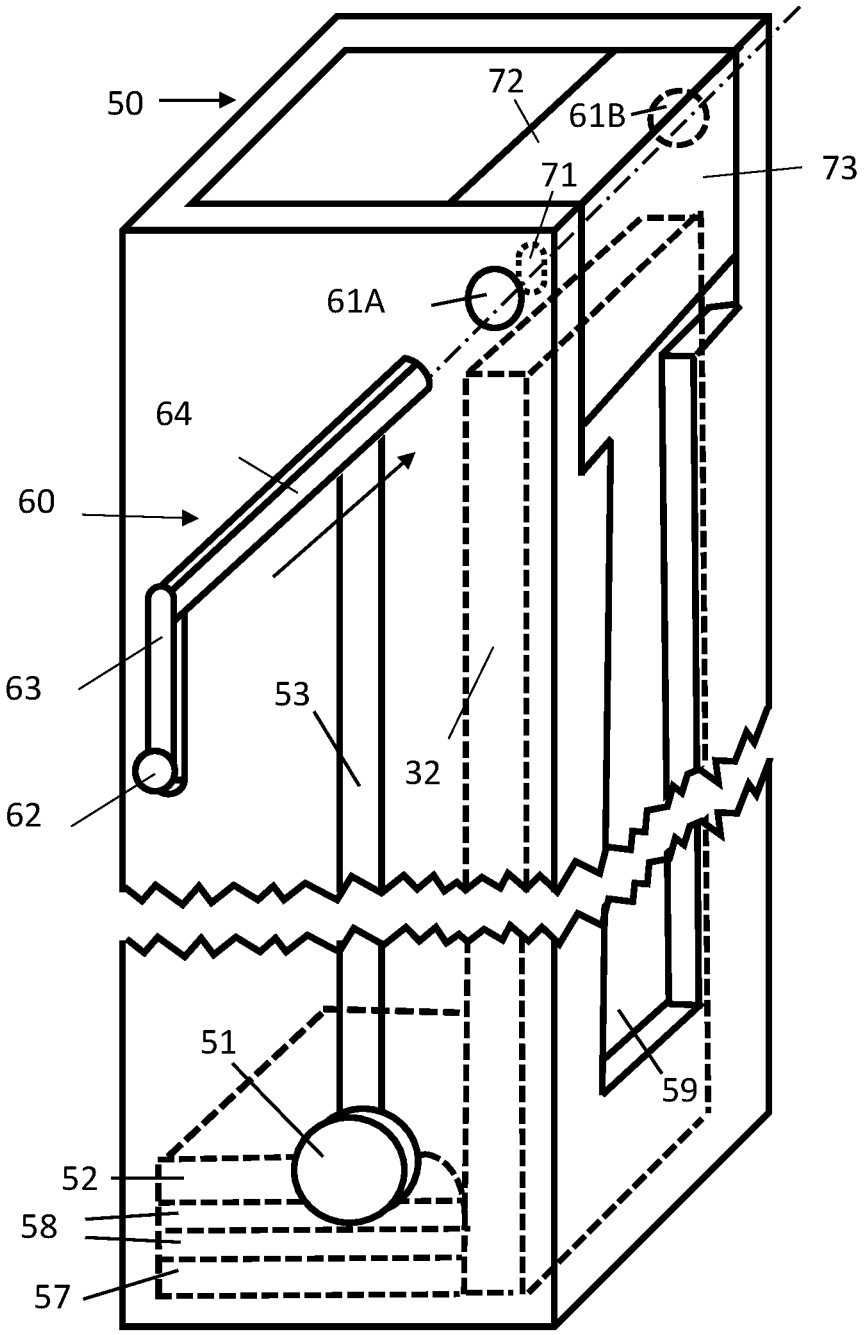
FIG. 6B shows a step pursuant to the step shown in FIG. 6A.

The top end of the side of the casing [50] with connector cavity [59] has possibly wider opening, referred to as operator cavity [56], designed to house the operator [70]. The top right corner of the side with slider cavity [53] has an opening referred to as front lever hole [61A] and the side across has one referred to as back lever hole [61B]. An embodiment of a lever [60] as shown in FIG. 6B has three components—slider stabilizer [62], lever handle [63], and lever anchor rod [64]. Once the pill shaft is secured in the casing [50], the lever [60] can be used to secure the operator [70] in place by passing the lever anchor rod [64] through front lever hole [61A] and then through operator lever cavity [71] to be secured in back lever hole [61B]. Phantom lines and arrow [92] in FIG. 6A illustrate the position and motion of the operator [70] during this assembly while FIG. 6B shows its position right before the lever anchor rod is put in place. The assembly is such that when lever handle [63] is rotated it also causes the operator [70] to rotate.

Figure 6C:
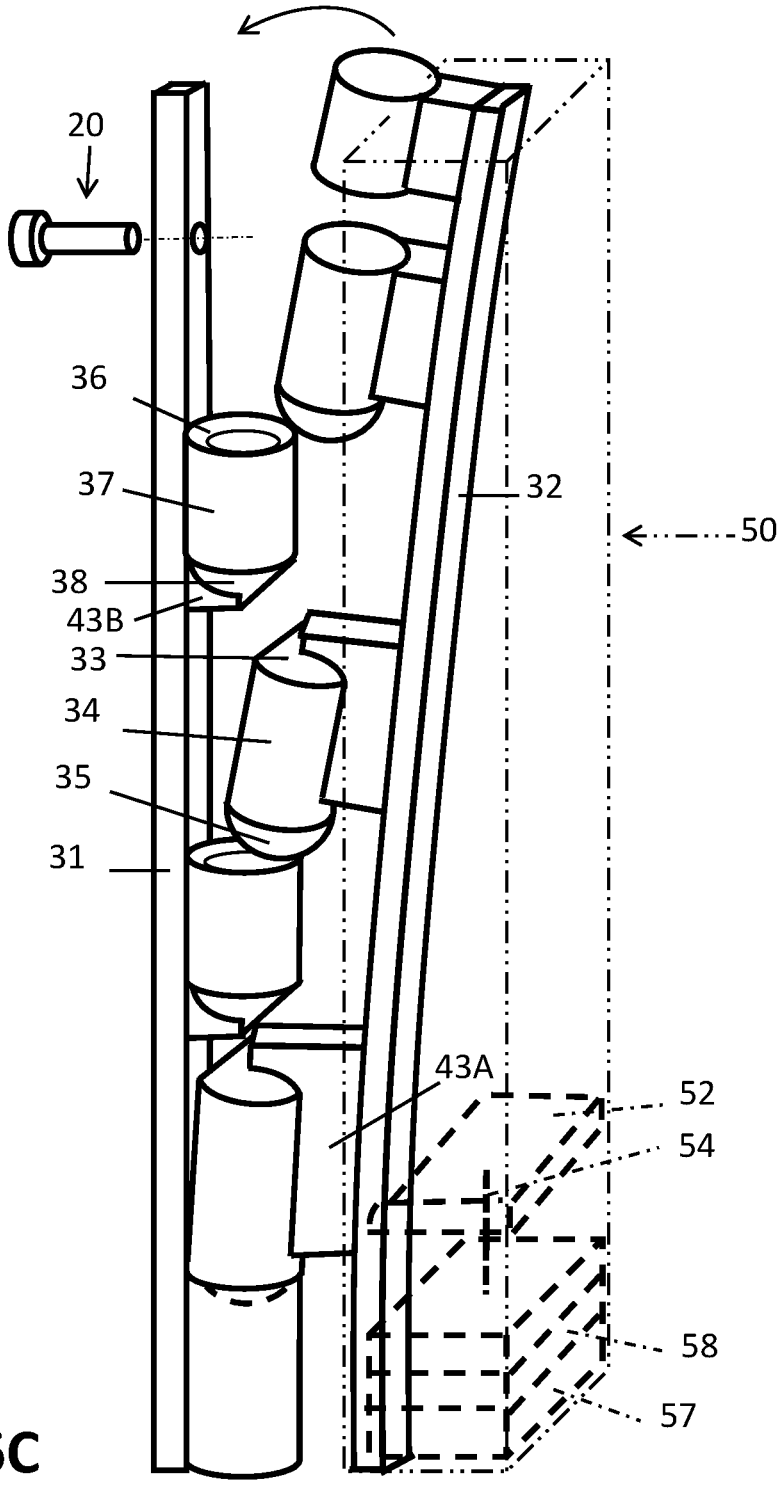
FIG. 6C shows the embodiment in 5A in the process of attaching. It also shows the position of the casing and its components from FIG. 6B.

FIG. 6C shows the position of the pill plate and the cavity plate in the process of attaching. In the embodiment shown in FIG. 6C the distance from bottom tip of the pill to its top is more than the distance between the top of a cavity socket where the pill enters the cavity saucer and the lower end of the cavity socket right above it. This means that the pill can only enter the cavity saucer at an angle.

In order to explain the operation of the joining mechanism let us assume that there is a pill plate with n pills and cavity sockets. Let us refer to the lowest pill as x and the one above it as x+1, and so on. Similarly, let us refer to the lowest cavity socket as y and the one above it as y+1, and so on. The process of attaching starts with placing the pill bottom [35] of x in the cavity saucer [36] of y. When force is exerted to bring the pills towards the cavity sockets, pill x settles completely in the space between y and y+1. At the same time the pill shaft [32] bends momentarily right above x and causes x+1 to incline. This reduces the vertical length x+1 in relation to the axis of the cavity shaft [30] and causes it to enter cavity saucer [36] of y+1 in a curvilinear motion. The force being exerted causes x+1 to straighten in the space between y+1 and y+2. At this time, the pill shaft [32] bends momentarily above x+1 and cause x+2 to incline. This process repeats till all the pills are in their respective cavity sockets and the mechanism is in equilibrium. This process results in an overall curvilinear motion for the pill shaft in the embodiment shown in FIG. 6C.

Once all pills are in place, the lock pin [20] is inserted in its respective cavity to ensure that the equilibrium is maintained and not disturbed accidently. This equilibrium once reached can only be disturbed if force is exerted to cause the topmost pill x+n to dislodge from the saucer of y+n. This requires bending of the pill shaft [32] away from cavity plate [30] below pill x+n. However, the lock pin mechanism ensures that does not happen.

When slider [52] as shown in FIG. 6C is slid from the bottom to the top it causes pressure successively at appropriate points on the pill shaft for the process to work.

Figure 6D:
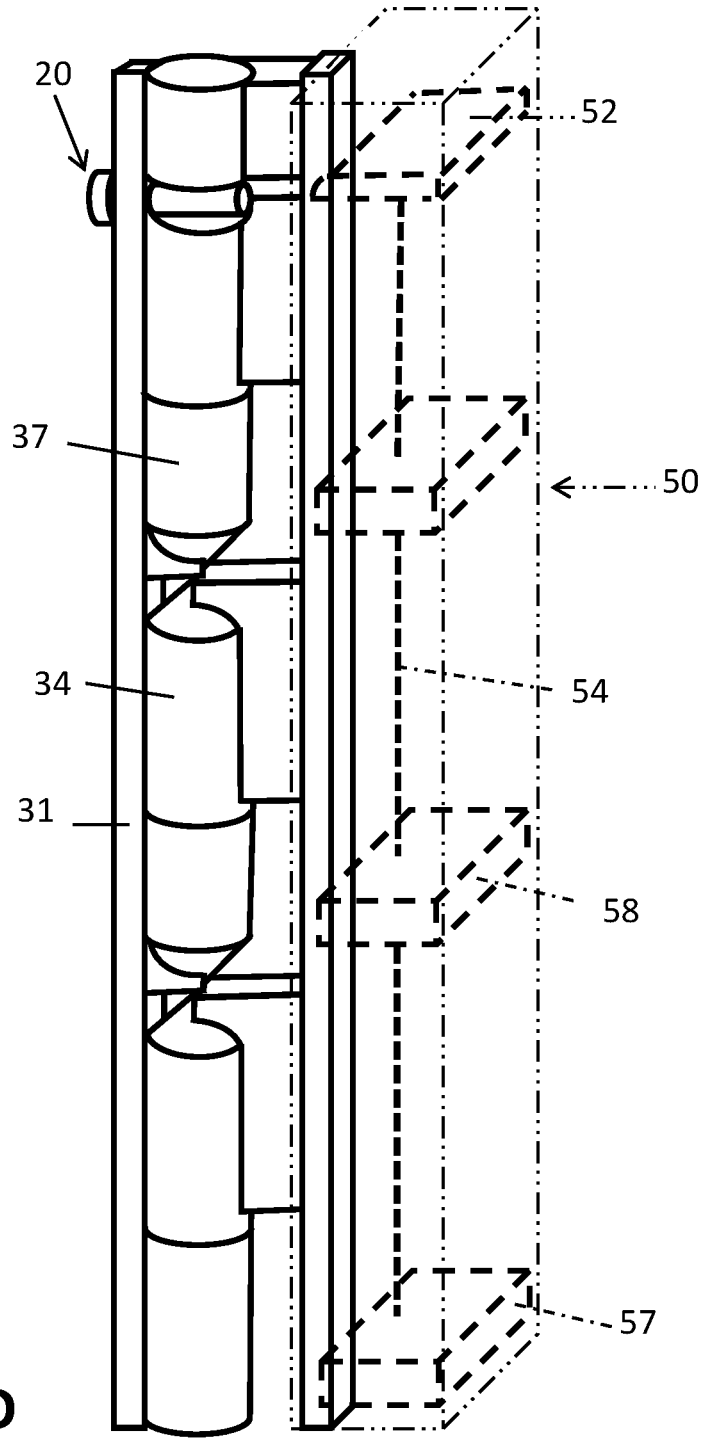
FIG. 6D shows the embodiment in 5A when attached. It also shows the position of the casing and its components from FIG. 6B.

In the embodiment shown in FIG. 6C the slider [52] is connected to support tiles [58] via a cord [54]. As a result, when the slider is slid upwards to cause the pill plate to engage with the cavity plate, the support tiles also rise. FIG. 6D shows the position of these tiles when the joining mechanism is engaged, and the slider [52] is at the top position. The support tiles [58] in conjunction with the slider [52] and the pill shaft anchor [57] keep the pill shaft [32] snug with the inner surface of the appropriate side of the casing [50].

Figure 7A:
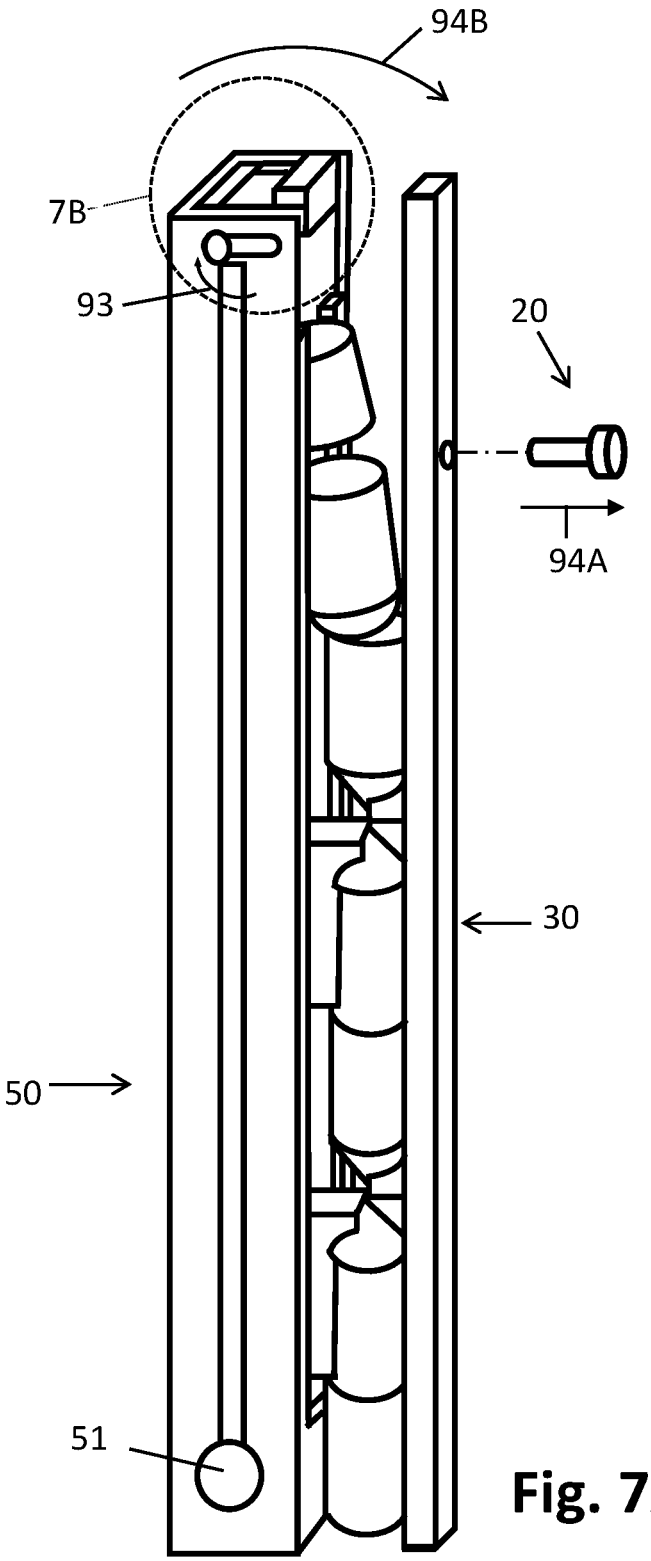
FIG. 7A shows the embodiment in 4A in the process of detaching.

When intentionally detaching the two objects, the lock pin is pushed away from its cavity by thumb, as shown by arrow [94A] in FIG. 7A, while also exerting the force on the top end of the objects, pulling them away from each other. This causes the pill shaft to be pushed away from the cavity shaft. It bends at the top thereby causing the top pill x+n to incline and exit the respective cavity socket, once again in a curvilinear motion. The process then follows downward the same way it did when attaching the objects, but in reverse, as each pill dislodges and the pill shaft [32] bends below the pill just released. For the user, this results in curvilinear motion overall to detach the objects.

FIG. 7A shows the embodiment in FIG. 4A in initial stage of the process of detaching, wherein the lock pin has been removed, the slider [52] has been slid down, and the top part of the pill shaft [32] has been forced away from the cavity plate [30]. In FIG. 7A this has been caused by rotation of the lever handle [63] in the direction of arrow [93]. Note the position of the slider knob [51] in relation to slider stabilizer [62] in FIG. 4A. When the joining mechanism is engaged, the slider stabilizer prevents the slider [52] from sliding down due to vibration or accidental force. At the same time, the slider knob prevents accidental turning of the lever [60]. The embodiment in FIG. 4A requires that the slider be slid down before the process of detaching can begin. Note the position of the slider knob [51] in FIG. 7A.

Figure 7B:
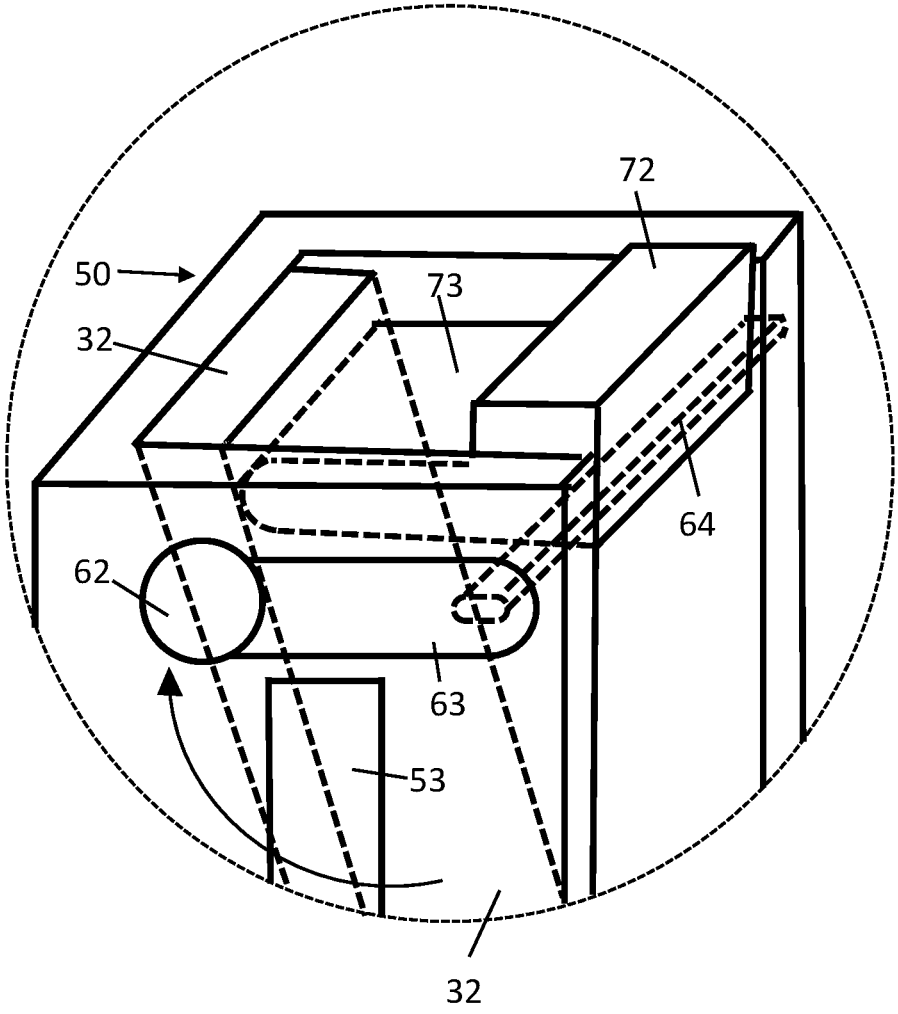
FIG. 7B shows the enlarged view of the top end of the casing in FIG. 7A.

FIG. 7B shows enlarged view of the top part of the casing in FIG. 7A. It shows that rotating the lever handle [63] in the direction of the arrow causes lever anchor rod [64] to rotate, thereby causing pill shaft operator [73] to rotate, which causes pill shaft [32] to bend and move towards the side of the casing across from the side with connector cavity [59], initiating the process of detachment, dislodging the topmost pill on the pill shaft [32]. A user can detach objects joined using the embodiment of the mechanism in FIG. 7A by rotating the lever handle [63] with a thumb, pushing the anchor pin [20] with the other thumb, and then pushing the objects apart in a slightly curvilinear motion as shown by arrow [94B] in one continuous motion. The curvilinear motion to pull objects apart is similar in an embodiment without casing, the only difference being, the user does not have to use one of the thumbs to turn the lever handle [63].

Figure 8A:
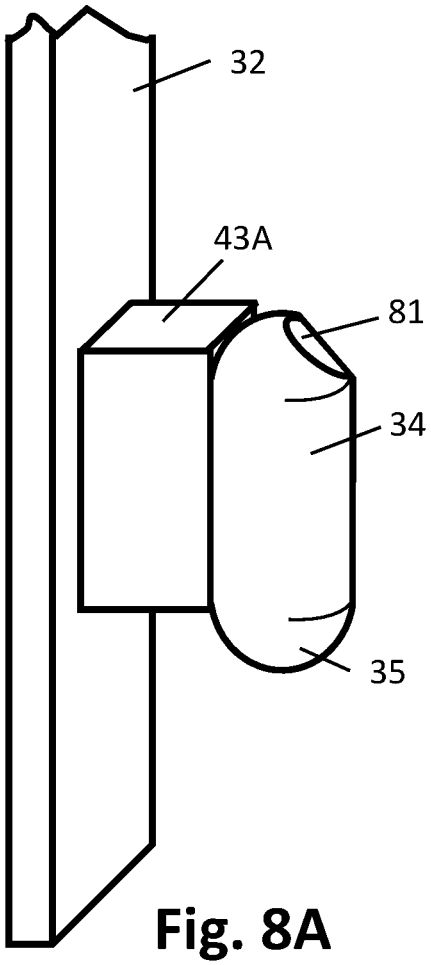
FIG. 8A shows side view of an embodiment of pill plate with limited zone on pill guide for attaching and detaching
Figure 8B:
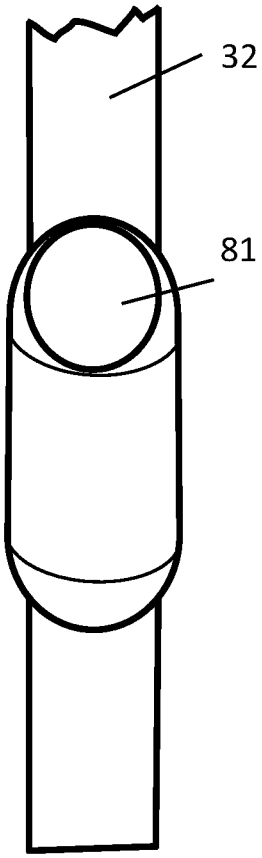
FIG. 8B shows front view of the embodiment in FIG. 8A.

FIG. 8A shows side view of an embodiment of pill plate [40] with narrow zone of entry and exit for attaching with cavity plate [30]. FIG. 8B shows the front view of the embodiment in FIG. 8A. The narrow pill guide [81] in FIG. 8A and FIG. 8B have a smaller depression than the pill guide [33] shown in prior embodiments.

Figure 8C:
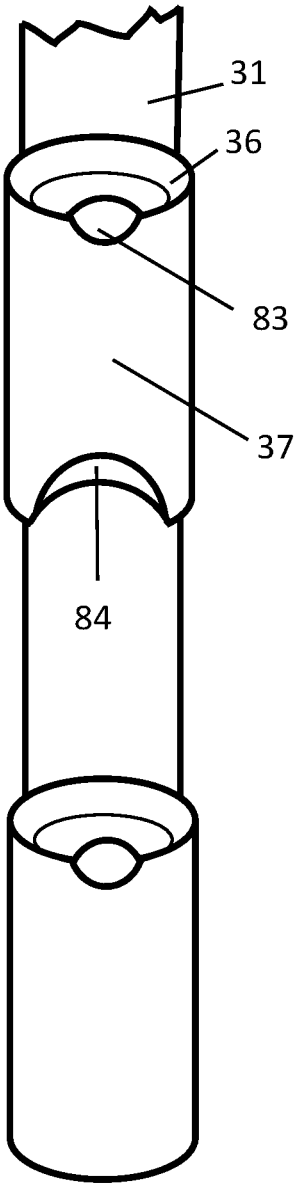
FIG. 8C shows front view of an embodiment of cavity plate with limited entry and exit zones.
Figure 8D:
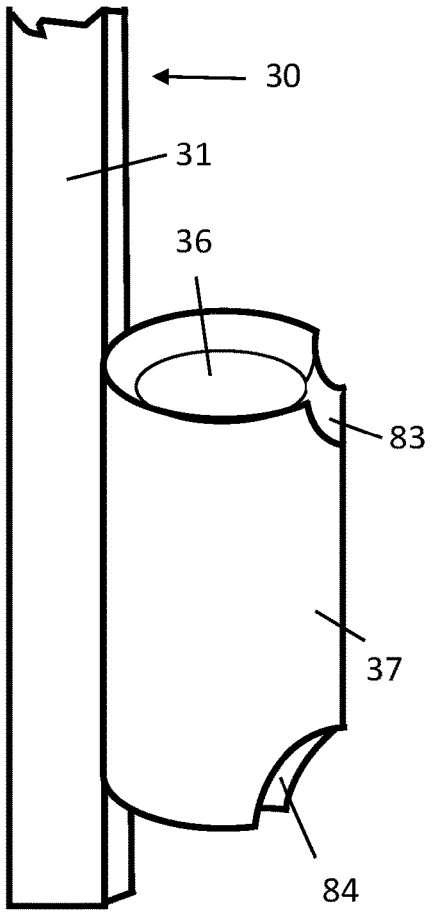
FIG. 8D shows side view of an embodiment of cavity plate with limited entry and exit zones.

FIG. 8C shows front view of cavity plate with narrow zone of entry and exit. FIG. 8D shows a side view of the embodiment in FIG. 8C. The narrow cavity guide [84] in FIG. 8A and FIG. 8B have a smaller depression than the cavity guide [38] shown in prior embodiments. Embodiment of the cavity plate in FIG. 8C also has additional depression in the cavity saucer, referred to as saucer guide [83], to facilitate entry and exit of the pills in the cavity saucer. Saucer guide [83] can be used to reduce flexibility requirements of shafts for momentary bending during operation. However, the saucer guide should not be deep enough to completely eliminate the need for momentary bending. If that were to happen, attached objects could unintentionally get detached in some situations. In addition to the narrow pill guide [81] and narrow cavity guide [84], the saucer guide [83] can also be used to adjust the permitted zone of exit and entry for pills to engage with cavity sockets.

Figure 8F:
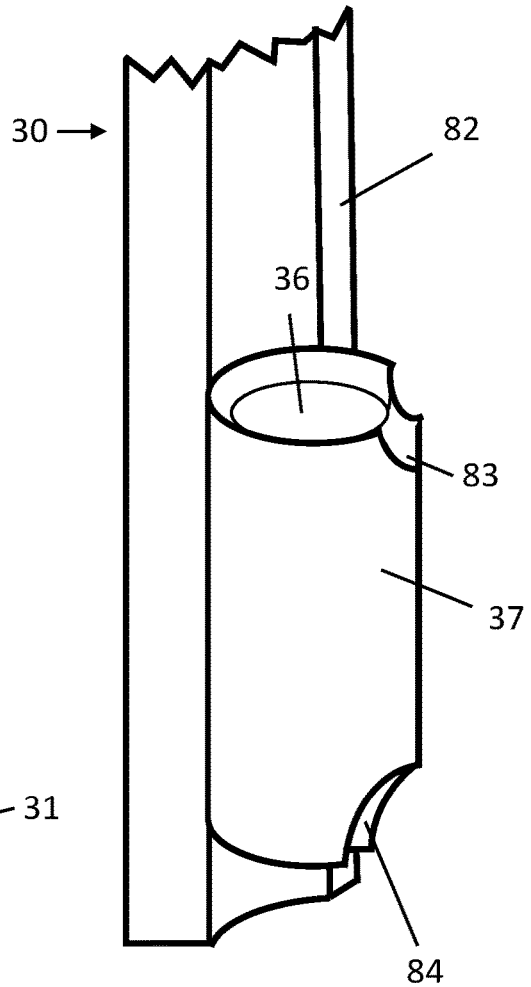
FIG. 8F shows an embodiment of cavity plate with enhanced cavity shaft to limit the rotation.
Figure 8E:
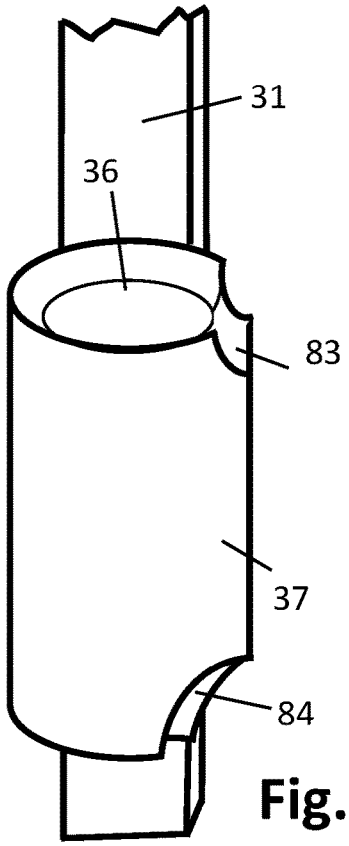
FIG. 8E shows a cavity plate where cavity shaft is situated on a different side of the cavity sockets.

FIG. 8E shows an embodiment of cavity plate [30] wherein the cavity shaft [31] is attached to cavity sockets at a different angle (at about 90° compared to 180° in FIG. 8D). The positioning of the cavity shaft [31] and the pill shaft [32] in relation to their cavity sockets and pills, respectively, can be changed to allow attachment and detachment at any angle, as desired.

FIG. 8F shows an embodiment of cavity plate [30] as in FIG. 8D, but with a cavity shaft that surrounds a larger portion of the cavity sockets. As the extended cavity shaft [82] surrounds bigger part of the cavity sockets, the permitted angle of rotation for the joining mechanism decreases. This can be used to control the rotation of the attached objects.

For example, an embodiment of a pill plate [40] with a slender pill shaft [32], when attached to the embodiment of the cavity plate in FIG. 8D, could rotate almost 330° or more. In comparison, the maximum rotation permitted for the same pill plate in conjunction with the embodiment of the cavity plate in FIG. 8F would not exceed 300°. This is because the extended cavity shaft [82] blocks movement of the pill plate for some angles that were permitted in the embodiment shown in FIG. 8D. In addition to the size of the pill shaft [32] and/or cavity shaft [31], the thickness of the pill connectors [43A] and/or cavity connectors [43B] can also be used to limit the permitted angle of rotation.

The main purpose of the lock pin [20] is to prevent the joining mechanism from falling out of equilibrium unintentionally. Both the pin [41] and the pin head [42] can be of any shape. The pin [41] should be made of a material rigid enough, and be of sufficient length, so as to serve the intended purpose.

Figure 8G:
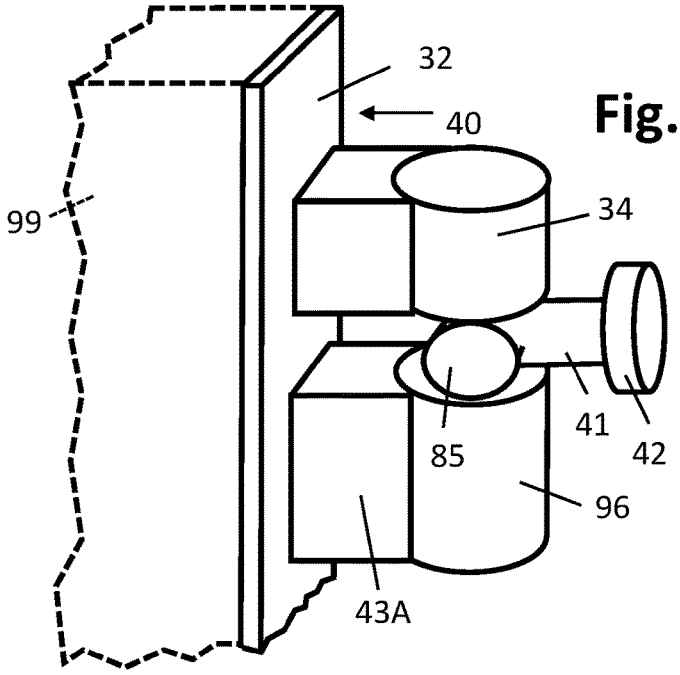
FIG. 8G shows an embodiment of a lock pin with anchor lock extension before it is fully engaged.
Figure 8I:
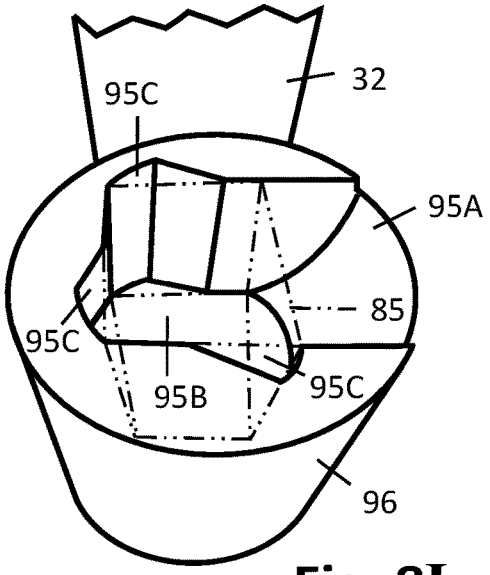
FIG. 8I shows front perspective view from above of an embodiment of the groove for anchor lock extension that allows for limited rotation.
Figure 8H:
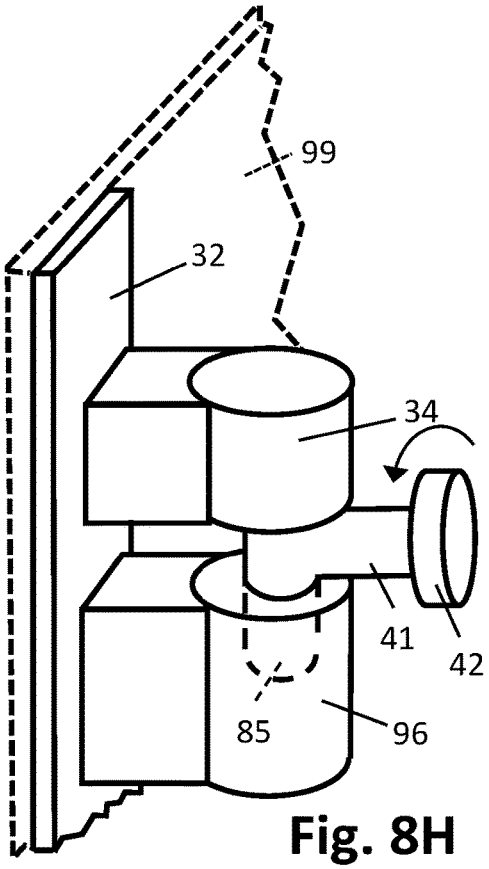
FIG. 8H shows the embodiment of lock pin in FIG. 8G after it is fully engaged.

In some applications, there might be consistent or unintended force being exerted to the area of the lock pin [20], for example, when the joining mechanism is used to attach a heavy or a hanging object. In such instances, the pin [41] may have a protrusion that can act as an anchor to counteract the unintended force. The same may be desirable in applications involving vibrations. FIG. 8G and FIG. 8H show an embodiment of such protrusion referred to as anchor extension [85]. The relevant pill body, hereafter anchoring pill [96], would then have a cavity in the appropriate manner to allow for the anchor extension [85] to slide into it when pin head [42] is rotated as in FIG. 8H and to fit neatly to hold anchor. FIG. 8H shows the position of the anchor extension [85] when it is fully engaged, that is, anchored.

Either, or both, of the pill body [34] adjacent to the location where lock pin [20] engages can function as anchoring pill [96].

The rotation of the pin may be facilitated by slide of the thumb over pin head [42]. When detaching the objects, a user can rotate the pin head using the thumb to turn the anchor extension [85] to achieve its position as in FIG. 8G from its position shown in FIG. 8H. The user would then push the pin [20] away from the pill shaft [32] using the same thumb to apply pressure on pin head [42], and then pull apart objects [98] and [99]. These actions can be performed in one continuous motion. For ease of illustration, FIGS. 8G and 8H do not show cavity shaft [31] that would generally be between pin head [42] and pill body [34].

The shape of anchor extension [85] and cavity in the anchoring pill [96] may also be used to restrict rotation of the joining mechanism that may be otherwise permitted based on the design of the pill shaft [32] and the cavity shaft [31]. For example, the anchor extension [85] in FIG. 8H, shown in dashed lines, is cylindrical and is at a right angle to the pin [41]. The vertical axis of rotation for the anchor extension [85] aligns with the axis of rotation for the joining mechanism. This permits rotation of the attached objects even when the pin [85] is anchored.

However, if the shape of the anchor extension [85] were to be cuboidal and the cavity were to be of appropriate shape to allow for sliding in of the anchor extension [85] on rotation of pin head [42] and fit the cuboid anchor extension snugly when in place, then the joining mechanism would not rotate when the anchor extension [85] is anchored.

It needs to be noted that the lock pin [20] with anchor extension [85] can serve the intended purpose of maintaining equilibrium of the joining mechanism even when the anchor extension [85] is not in anchored position. The anchor extension [85] when not anchored does not interfere with the rotational capabilities of the joining mechanism either.

The shape of the lock pin [20], anchor extension [85], and/or the cavity can be used to allow users to rotate the object within a narrower range than permitted by the design of the shafts. FIG. 8I shows an embodiment of extension cavity that permits a narrow range of rotation of the joining mechanism. To facilitate elucidation of the elements of extension cavity in the anchoring pill [96] FIG. 8I does not show the lock pin [20]. It shows the front perspective view from above of an embodiment of the anchoring pill [96]. It does not show the components of pill plate [40] below or above the anchoring pill other than the position of the pill shaft [32]. The phantom lines show the position of the anchor extension [85] when anchored.

The cavity in the embodiment of the anchoring pill shown in FIG. 8I can be thought to have three spaces. The space inside the phantom lines, referred to as anchoring cavity [95B], holds a cuboidal anchor extension [85] when anchored. The space of the cavity designed to allow the anchor extension to slide in the anchoring pill [96] in the process of engaging, when pin head [42] is rotated, is referred to as engaging cavity [95A]. It constitutes the space from the edge of the anchoring pill to the anchoring cavity [95B] in FIG. 8I. The cavity space created by grooves designed to allow for limited rotation of the joining mechanism is referred to as rotating cavity [95C]. The cavity in the anchoring pill can be designed in any shape to lock the joining mechanism at a position and/or to permit rotation within a range.

Figure 8J:
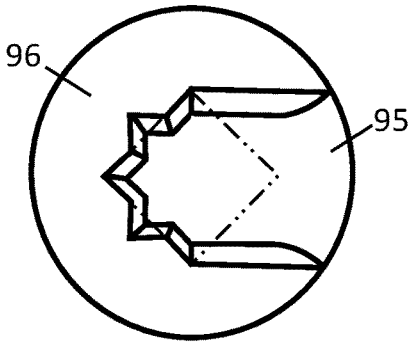
FIG. 8J shows top perspective view of an embodiment of the groove for anchor lock extension that allows for locking the joining mechanism at an angle after rotation.

FIG. 8J shows top perspective view of an embodiment of anchoring pill [96] designed to lock a cuboidal pin in place at a defined angle after rotation of the joining mechanism. The phantom lines show the shape and position of the anchor extension when locked. Even though, for ease of illustration, the embodiment shown in FIG. 8J only allows for locking in two positions, the anchoring pill cavity [95] can be designed with more notches to allow for locking in any number of positions.

As is shown in FIG. 8H and FIG. 8G the shafts of the joining mechanism can be prebuilt in or attached to different sides of the object. In FIG. 8G the pill shaft [32] is attached to the side of the object [99] while in FIG. 8H it is attached to the main face.

Figure 9A:
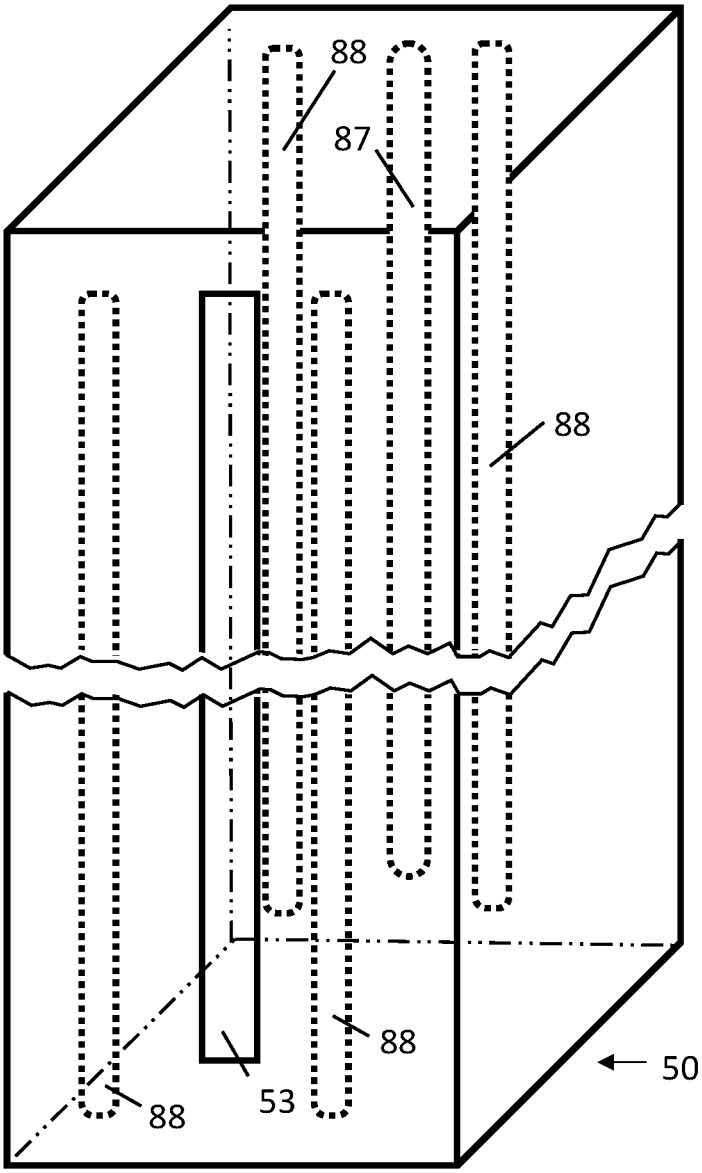
FIG. 9A shows grooves on the inner side of the casing to guide the slider and the support tiles for embodiment shown in FIG. 4A.

To provide support and maintain the structural integrity of casing [50] and the pill shaft [32], support tiles [58] may be snugly fit in grooves using protrusions. This mechanism ensures that, when engaged, pill shaft [32] is snug with the appropriate inner wall of the casing. It also assists with prevention of undesired bending of the pill shaft. FIG. 9A shows the positioning of grooves and slider cavity [53] in an embodiment of casing [50] and omits all other features. FIG. 9C shows an embodiment of the support tile with two tabs [76] designed and positioned to neatly fit in support grooves [88] on the side of the casing with slider cavity [53] and two tabs to fit in respective grooves on the parallel side.

Figure 9B:
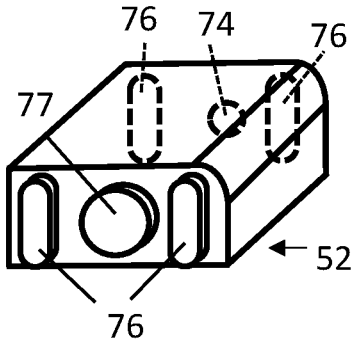
FIG. 9B shows an embodiment of slider used in the embodiment shown in FIG. 4A.
Figure 9C:
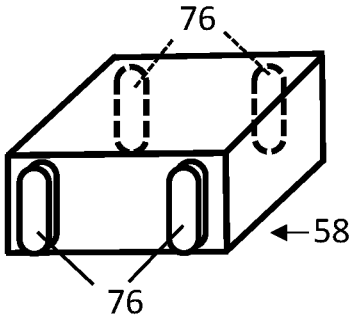
FIG. 9C shows an embodiment of a support tile used in embodiment shown in FIG. 4A.

For exerting desired force on the pill shaft [32] to cause momentary bending during operation, the top edge of the slider [52] facing the pill shaft is beveled in the embodiment of the slider shown in FIG. 9B. The slider in FIG. 9B has tabs [76] positioned and designed to fit respective grooves [88] in the casing. The embodiment of casing in FIG. 9A has slider groove [87] in the side across from the slider cavity. It can be of a different shape, size, and/or depth than support groove [88]. A protrusion on the slider tab designed to fit and slide in the slider groove [87], referred to as slider tab [74], assists in smoother operation of the slider [52]. The embodiment of the slider in FIG. 9B also has a protrusion designed to attach with slider knob [51] through the slider cavity [53] in the casing. Alternatively, the slider may be designed to directly connect with the slider knob [51] by a screw.

To accommodate use of the present invention to attach objects generally perceived to be rigid, the shape and size of the pill bottoms [35] and cavity saucer [36], the length and/or diameter of pill body [34] and the cavity body [37], the number of pills and the distance between them, the shape and size of the pill guide [33] and cavity guide [38], the size and material of pill connectors [43A] and cavity connectors [43B], and/or the material of the joining mechanism can be adjusted to benefit from the slightest of the momentary flexibility that can be extracted to reduce the size of the required cavity in the casing.

The embodiment shown in FIG. 5A has a semi-sphere-shaped pill bottom [35] and the cavity saucer [36] has a similar semi-sphere-shaped cavity to house the pill. The shape of pill bottom [35] and the cavity saucer [36] can be changed in different applications. For example, the cavity saucer can have a cone-shaped cavity instead of a semi-sphere. Similarly, the dimensions, for example, the depth, of the pill bottom [35] and cavity saucer [36] can be adjusted.

The pill shaft is flexible in embodiments discussed herein. However, in an embodiment where the cavity shaft is flexible, the cavity sockets will incline to assist in the entry and exits of pills in their respective cavity saucers, and result in curvilinear motion of the cavity sockets and the cavity shaft overall. Both the cavity shaft and the pill shaft can also be flexible at the same time.

Though it might appear so, the present mechanism is not strictly a hinge mechanism, rather it is a mechanism to join two objects or surfaces in a way that allows for easy detachment. The fact that it allows for rotation around an axis is an added benefit. When two planks need to be attached like a "T" such that they can be easily separated when desired, it can be done using the present invention. The mechanism can be used to attach two surfaces side by side, at 90°, or at any other angle.

In some situations, there may not be meaningful distinction between the cavity shaft and the pill shaft because each of them may have both cavities and pills based on the specific needs of the application. This will not compromise the functionality of the present mechanism though.

The present invention lends itself better to applications requiring low clearance on the top or the bottom of the object during installation. This is because the minimum clearance required for the present invention, the depth of the cavity saucer [36] relative to the entry point of the first cavity socket, can be easily adjusted.

Most of the things are now made of plastic. Plastic provides the necessary level of elasticity and stiffness required in the present invention for smooth curved motion. Not needing a new material to be included in the manufacturing process is a big plus. The joining mechanism can now be a part of the mold. Otherwise, till now the hinges were made of metal or at least had a metal rod supporting the axis in the middle. Now the entire product can be metal-free, if required.

The present method allows for either having some or all of the requisite components prebuilt into the objects by the manufacturer. Given that the present method works with wide range of materials, it enhances the applicability of the method to wide range of uses and environments. Additionally, it allows easier adoption by manufacturers since they are not required to accommodate their facilities for handling and storage of material they do not currently use.

With the present invention the manufacturers can ship products that can be assembled and installed by the end users without the need for professional installation or tools. This is in addition to the no-tool easy attachment and detachment in one motion feature, one of the core objectives of the present invention.

Even when manufacturers do not adopt the mechanism, the requisite components of the mechanism can be directly sold to the end users for widespread use. It can be sold in hardware store as strips of shafts with lock pin cavities at regular intervals where the users can cut the strips at desired location and attach to objects with adhesive or any other attachment mechanism provided with the product.

Given the possibility of easy attachment and detachment, the users can now more easily replace bad parts instead of discarding the whole object, thereby having a positive impact on the environment.

Objects attached using our joining mechanism will stay attached no matter in which direction they are placed. Even when upside down or hanging from the ceiling the joining mechanism will work. Currently when somebody accesses something in the attic, the cover remains hanging around the hinge. This limits workspace and has the potential to cause injury. At minimum, a hanging plank is a nuisance. Our mechanism will allow a worker to easily remove a hanging cover and place it out of their way.

Electricity circuit breaker boxes are often located underneath the stairs. These are tight spaces. If an electrician needs to work in that space, the space occupied by the cover of the box when open is a nuisance that limits the movement of the electrician to some extent. If the cover of the electricity box were to have our joining mechanism, the electrician could simply remove the cover in one motion and go about working on the real issue with more ease. There would not be any need for a screwdriver or any other tool.

Often the entryways to homes are narrow and may not allow for an item to be transported through them. Being able to easily remove doors and covers may allow for the passage.

The invention claimed is:

1. An apparatus for attaching and detaching hard objects that allows for rotation of the attached objects around an axis, the mechanism comprising series of cavity sockets, the said socket either built into one of the objects during manufacturing or on a shaft attached to the object, and a series of protrusions on a flexible shaft housed in a casing, the said casing built into the other object during manufacturing, or attached to the object;

wherein the objects are rotationally attached to one another when the said protrusions are sequentially positioned respectively into the said cavity sockets by applying a force on the shaft housed in the casing to momentarily bend said shaft at corresponding locations of each of said protrusions by sliding a sliding mechanism in one direction, the said sliding mechanism comprising of a handle, extending out from a side of the casing, connected to a plate abutting a back of the shaft housed in the casing; and the attached objects are detached from each other by sliding the handle of the sliding mechanism in the opposite direction and exerting force to pull apart the attached objects to sequentially dislodge the protrusions from the sockets.

2. The joining mechanism in claim 1, wherein a lock pin mechanism comprising of a lock pin with a multi-surfaced protrusion and a recess is used to lock the position of attached objects at an angle to each other with respect to the axis of rotation, by turning a knob to cause the protrusion of the lock pin to lodge into the recess, the said lock pin being cylindrical and connected to a knob at one end and having a protrusion with multiple planar surfaces toward the other end, and inserted through a hole in one of the shafts, and the said recess in one of the surfaces of the opening in the other shaft, the said opening adapted to receive the lock pin, is of appropriate shape to permit entry and exit of the protrusion of the lock pin and lock it in one or more positions.

3. The lock pin mechanism of claim 2, wherein the number of planar surfaces of the multi-surfaced protrusion of the lock pin and the shape of the recess determine the number of positions the joining mechanism can be locked into and the permitted angular positions of the attached objects relative to each other with respect to the axis of rotation.

4. The joining mechanism in claim 1, wherein the shaft housed in the casing is stabilized and kept snug to the wall of the casing facing the other object, by one or more support tiles, connected to each other by string like material, situated within the space between the shaft and the side of the casing attached to the object, and abutting both the shaft and the casing, wherein the top support tile connected to the sliding mechanism moves up and down with the slider of the said mechanism thereby causing other support tiles to position themselves such that the shaft does not bend unintentionally.

5. The joining mechanism in claim 1, wherein a lever mechanism, comprising of a handle and a rod attached to a plate positioned vertically over the opening in the casing for the protrusions of the shaft housed within it, is used to prevent accidental slide of the slider when the mechanism is in use to attach objects, and to initiate the detaching sequence by turning the handle, thereby causing the topmost protrusion from the shaft to dislodge from its cavity on the other shaft.

* * * * *